US007387434B2

(12) United States Patent
Hiranuma et al.

(10) Patent No.: US 7,387,434 B2
(45) Date of Patent: Jun. 17, 2008

(54) LOCKABLE PUSH BUTTON FOR PORTABLE APPARATUS SUCH AS A WATCH

(75) Inventors: Haruki Hiranuma, Chiba (JP); Kinshuroh Itoh, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/542,767

(22) Filed: Oct. 4, 2006

(65) Prior Publication Data

US 2007/0074545 A1 Apr. 5, 2007

(30) Foreign Application Priority Data

Oct. 5, 2005 (JP) ..... 2005-292006

(51) Int. Cl.
*G04B 29/00* (2006.01)
*G04B 37/00* (2006.01)

(52) U.S. Cl. ..... 368/319; 368/290

(58) Field of Classification Search ..... 368/319, 368/288–290, 308, 190–191, 320–321
See application file for complete search history.

(56) References Cited

U.S. PATENT DOCUMENTS 2,309,428 A * 1/1943 Aegler ..... 368/288
3,362,154 A * 1/1968 Perret ..... 368/290
4,313,187 A * 1/1982 Waki et al. ..... 368/319
6,872,899 B2 * 3/2005 Oshio et al. ..... 200/43.13

* cited by examiner

*Primary Examiner*—P. Austin Bradley
*Assistant Examiner*—Sean Kayes
(74) *Attorney, Agent, or Firm*—Adams & Wilks

(57) ABSTRACT

There is provided portable apparatus capable of maintaining a function of preventing accidental operation of a push button when the apparatus is carried on the wearer's body. The apparatus includes a watch enclosure body (apparatus enclosure body), a pipe, a push button, a biasing member, a locking member, and a whirl-stop. The pipe is fixed to the enclosure body by inserting it into a through hole in the enclosure body. A retainer tube of the pipe has a female thread formed thereon and is disposed outside the enclosure body. The push button has a shaft passed through the pipe, a detent for preventing the push button from being pulled out of the pipe, and a manipulator head disposed outside the enclosure body. The biasing member biases the push button outward with respect to the enclosure body. The locking member has an inner wall with a male thread and a stopper projection that comes into contact with and moves away from the head, and an outer wall that fits on the tube. The locking member is movably attached to the tube by engaging the threads with each other. The whirl-stop that provides rotational resistance on the locking member is sandwiched between the outer wall and the tube.

20 Claims, 4 Drawing Sheets

LOCKABLE PUSH BUTTON FOR PORTABLE APPARATUS SUCH AS A WATCH

BACKGROUND OF THE INVENTION

1. Field of the Invention

The present invention relates to a portable apparatus and a watch with a push button.

2. Description of the Prior Art

Some portable apparatus, including watches such as wristwatches and pocket watches, stopwatches, mobile phones, and personal digital assistants, have a push button that is attached to an enclosure body of the apparatus and activates a contact or the like therein. In a quartz watch, for example, pressing the push button can switch the time display from an analog form to a digital form, or allows correction of date and day displayed in a digital form.

Conventionally, to prevent accidental operation of the push button, portable apparatus of this type have a locking member having a female thread formed on the inner surface thereof, and the female thread engages a male thread formed on the outer surface of a pipe that is attached to the apparatus enclosure body. The locking member is configured to be movable between a locked position and an unlocked position by changing the position where these threads engage with each other. When the locking member is placed in the unlocked position, a stopper of the locking member is separated from a head of the push button passed through the pipe, allowing the push button to be pushed in with a travel corresponding to the separation distance. Conversely, when the locking member is placed in the locked position, the stopper comes into contact with the head of the push button, thereby preventing the push button from being pushed in.

The technique described in JP-A-2003-7164 does not have a feature for holding the locking member in the locked position. Therefore, even if biasing force of a coil spring that biases the push button acts on the locking member, vibration or impact on the apparatus when it is carried on the wearer's body could change the position where the locking member and the pipe engage with each other. Consequently, the locking member may slide from the locked position to the unlocked position when the apparatus is carried on the wearer's body and the function of preventing accidental operation of the push button may be defeated. Therefore, there is a desire to avoid such a situation.

SUMMARY OF THE INVENTION

An object of the invention is to provide a portable apparatus and a watch capable of maintaining a function of preventing accidental operation of a push button when the apparatus is carried on the wearer's body.

To solve the above problem, the portable apparatus according to the invention comprises: an apparatus enclosure body having a through hole; a pipe having an insert tube and a retainer tube, the pipe fixed to the apparatus enclosure body with the insert tube inserted in the through hole and the retainer tube disposed outside the apparatus enclosure body; a push button having a shaft passed through the pipe, a detent for preventing the shaft from being pulled out of the pipe, and a manipulator head disposed outside the apparatus enclosure body; a biasing member that is sandwiched between the push button and the pipe and biases the push button outward with respect to the apparatus enclosure body; a locking member having an inner wall with a stopper projection that comes into contact with and moves away from the manipulator head and an outer wall that fits on the outer surface of the retainer tube, the locking member attached to the retainer tube by engaging the male thread with the retainer tube and the locking member movable in the axial direction of the retainer tube; and a whirl-stop that is sandwiched between the inner or outer wall and the retainer tube and provides rotational resistance on the locking member.

In this invention, the engagement between the locking member and the retainer tube may be achieved by forming a female thread on the retainer tube and a male thread on the inner wall of the locking member and engaging these threads with each other, or may be achieved by forming a male thread on the retainer tube and a female thread on the outer wall of the locking member and engaging these threads with each other.

In this invention, the whirl-stop may be made of frictional material, preferably rubber-based or plastic-based flexible frictional material. The whirl-stop maybe disposed in at least one of the inner surface of the outer wall of the locking member and the outer surface of the retainer tube of the pipe, or may be disposed in at least one of the outer surface of the inner wall of the locking member and the inner surface of the retainer tube. In consideration of assembling, the whirl-stop is preferably a ring member continuously extending in the circumferential direction around the outer or inner surface. It is, however, possible to provide a plurality of whirl-stops spaced apart along the circumferential direction. When a ring whirl-stop is used, it may also serve as a watertight gasket.

In this invention, as the whirl-stop sandwiched between the retainer tube of the pipe and the locking member that engages this tube provides rotational resistance on the locking member, vibration or impact will not cause accidental rotation of the locking member placed in a locked position where the locking member prevents the push button from being pushed in. Accordingly, the locking member is secured such that it will not accidentally move from the locked position and the function of preventing accidental operation of the push button may be maintained when the apparatus is carried on the wearer's body.

In a preferable embodiment of the portable apparatus according to the invention, a watertight ring gasket is sandwiched between the inner wall of the locking member and the manipulator head. In this invention, the watertight gasket may be disposed in at least one of the inner surface of the inner wall of the locking member and the outer surface of the manipulator head.

In this embodiment of the invention, the frictional force of the watertight gasket added as rotational resistance on the locking member may more reliably prevent accidental rotation of the locking member placed in the locked position. By placing the watertight gasket in the way mentioned above, the shaft of the push button, which is accommodated in the insert tube of the pipe, does not need an annular groove for attaching the watertight gasket and hence the strength of the shaft does not decrease. This arrangement is preferable in that impact caused when the portable apparatus is dropped or by other factors will not bend the shaft, otherwise resulting in decreased water resistant capability.

In a preferable embodiment of the portable apparatus according to the invention, the whirl-stop is a ring member and the frictional force generated between the watertight gasket and the manipulator head is smaller than the frictional force between the whirl-stop and the locking member.

This embodiment of the invention is preferable in that the push button will not be too resistant to move but smoothly moves.

To solve the problem mentioned above, the watch according to the invention is formed of any of the portable apparatus of the invention described above.

As the watch according to the invention is formed of any of the portable apparatus of the invention described above, there is provided a watch capable of maintaining a function of preventing accidental operation of the push button when the apparatus is carried on the wearer's body.

BRIEF DESCRIPTION OF THE SEVERAL VIEWS OF THE DRAWINGS

A preferred form of the present invention is illustrated in the accompanying drawings in which:

FIG. 4 is a cross-sectional view showing the portion of the watch of FIG. 1 to which a push button is attached with the push button pushed in;

FIG. 8 is a cross-sectional view showing the portion of the watch of FIG. 5 to which a push button is attached with the push button pushed in.

DETAILED DESCRIPTION OF THE PREFERRED EMBODIMENTS

A first embodiment of the invention will be described with reference to FIGS. 1 to 4.

Figure 1:
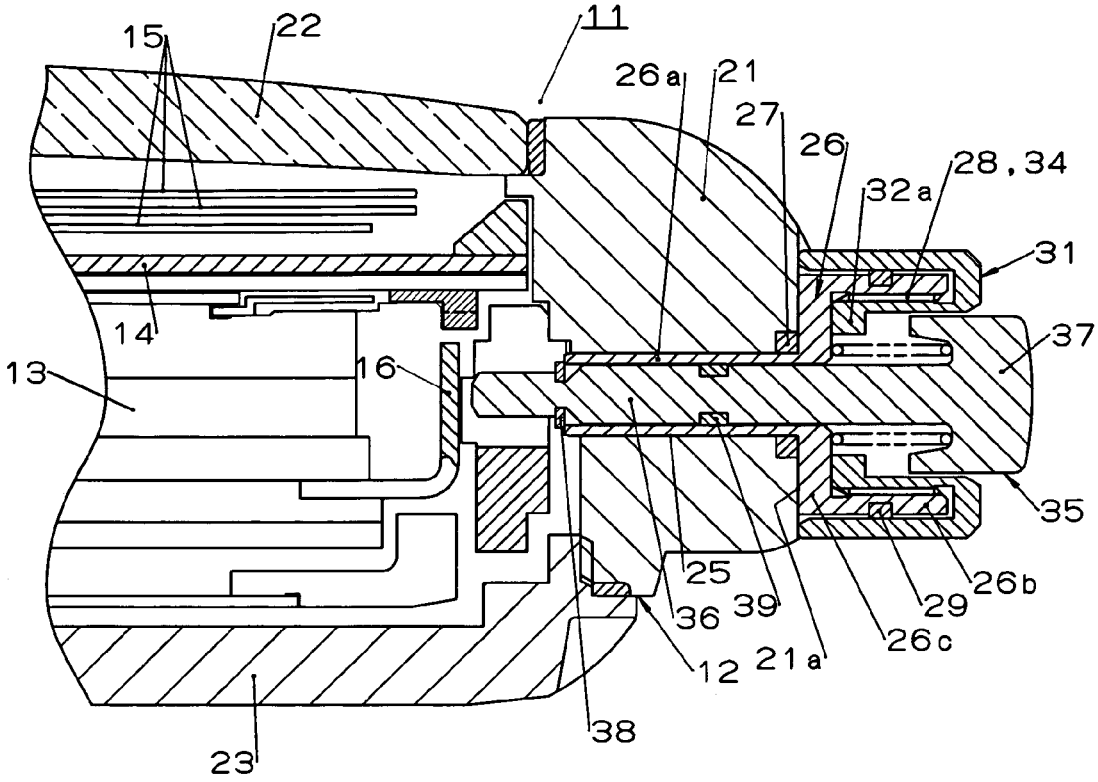
FIG. 1 is a cross-sectional view showing a part of the watch according to a first embodiment of the invention.

In FIG. 1, reference number 11 denotes portable apparatus such as a watch, specifically, a wristwatch. The wristwatch 11 includes built-in members in a watch enclosure body 12 that forms an enclosure body of the apparatus. The built-in members include a watch movement 13, a dial 14, and time displaying hands 15 such as an hour hand, minute hand, and second hand. The watch movement 13 that drives the time displaying hands 15 has a contact 16 formed of a leaf spring or the like. Pressing the contact 16 by a push button, which is described later, switches between functions of the watch movement 13.

As shown in FIG. 1, the watch enclosure body 12 is formed of an annular case band 21 made of metal, such as stainless steel or titanium, a cover glass 22 that is attached on one side of the case band 21 in the thickness direction in a liquid tight manner and that is transparent such that the dial 14 is visible, and a rear cover 23 made of metal, synthetic resin or the like that is attached on the other side of the case band 21 in the thickness direction in a liquid tight manner.

The case band 21 is provided with a crown (not shown) and a through hole 25 located at a position displaced from the crown. One end of the through hole 25 communicates with the interior of the case band, that is, the interior of the watch enclosure body 12. On the other end of the through hole 25 is provided a groove 25*a* for brazing, which is open through the exterior of the case band 21*a* (the exterior of the enclosure body).

In the case band 21 is fixed a tubular member in the form of a pipe 26 that has a circular cross section perpendicular to the axial direction. The pipe 26 is made of metal, preferably stainless steel or the like. The pipe 26 has an insert tube 26*a* and a retainer tube 26*b*. The insert tube 26*a* is a tubular retainer portion that has a smaller diameter than the retainer tube 26*b*, while the retainer tube 26*b* is a tubular retainer portion that has a greater diameter than the insert tube 26*a*. The insert tube 26*a* and the retainer tube 26*b* are integrally connected with a flange 26*c* to form the stepped-shaped pipe 26.

The pipe 26 is fixed to the watch enclosure body 12 with the insert tube 26*a* inserted in the through hole 25 and the retainer tube 26*b* disposed outside the case band 21. The pipe 26 is fixed by brazing with a metal brazing material 27 filled in the groove 25*a* for brazing. The brazing material 27 ensures watertightness between the pipe 26 and the case band 21. As described above, the flange 26*c* of the pipe 26 fixed to the case band 21 abuts the exterior of the case band 21*a* such that the flange 26*c* closes the groove 25*a* for brazing.

The retainer tube 26*b* has a female thread 28 formed on the inner surface thereof. The retainer tube 26*b* also has an open annular groove formed on the outer surface thereof and a ring whirl-stop 29 is attached in the groove. The periphery of the whirl-stop 29 juts from the groove. The whirl-stop 29 is made of rubber-based or plastic-based flexible material. A watertight ring gasket is suitably used for this purpose.

A ring-shaped locking member 31 is attached to the retainer tube 26*b* such that the locking member 31 is movable or displaceable in the axial direction of the retainer tube 26*b*. The locking member 31 is made of metal or synthesized resin and has an inner wall 32 and outer wall 33 that is longer than the inner wall 32. An annular groove 31*a* formed between these walls is open toward the exterior of the case band 21*a*. A male thread 34 is formed on the outer surface of the inner wall 32 of the locking member 31. A stopper projection 32*a* is integrally formed with the inner surface of the inner wall 32. The stopper projection 32*a* is formed at the end of the inner wall 32 that faces the exterior of the case band 21*a*. The stopper projection 32*a* is circularly shaped and continuously extending in the circumferential direction. The outer surface of the outer wall 33 constitutes a finger-grippable surface that can be gripped by the fingers of a user of the portable apparatus to rotate the locking member 31.

The locking member 31 is attached to the retainer tube 26*b* by engaging the male thread 34 of the locking member 31 with the female thread 28. In this way, the retainer tube 26*b* is placed in the annular groove 31*a* between the inner wall 32 and the outer wall 33 and the outer wall 33 fits on the outer surface of the retainer tube 26*b*. As the outer wall 33 presses and deforms the whirl-stop 29 when the outer wall 33 fits on the retainer tube 26*b*, the outer surface of the whirl-stop 29 is in close contact with the inner surface of the outer wall 33 in a slidable manner. By rotating the locking member 31 with a manipulation force greater than the frictional force generated by this close contact, the position where the male thread 34 and the female thread 28 engage with each other changes, allowing the locking member 31 to move in the direction toward or away from the exterior of the case band 21*a*, that is, in the axial direction of the retainer tube 26*b*.

The locking member 31 prevents a push button 35 from being accidentally pushed into the case band when the wristwatch 11 is worn on the wrist. The push button 35 is made of metal or synthesized resin and has a shaft 36, a manipulator head 37, and a detent 38. When the push button 35 is pushed in, the tip of the shaft 36 presses and moves the contact 16.

The shaft 36, which has a circular cross section perpendicular to the axial direction, is a portion that passes through the insert tube 26*a* of the pipe 26. The shaft 36 is provided with a watertight ring gasket 39 to form a water seal between the shaft 36 and the inner surface of the insert tube 26*a*. The watertight gasket 39 fits in a gasket attachment groove 36*a* formed in the shaft 36. The detent 38 is provided at the end of the shaft 36 that juts out into the case band. The detent 38 is a snap ring, for example, and hits the end face of the insert tube 26*a*, thereby preventing the push button 35 from being pulled out of the case band.

The manipulator head 37 integrally formed with the shaft 36 has a larger diameter than the shaft 36, while having a slightly smaller diameter than the inner diameter of the inner wall 32 of the locking member 31 except the stopper projection 32*a*. The manipulator head 37 has a stopper 37*a* that comes into contact with and moves away from the stopper projection 32*a* when the push button 35 moves in the axial direction. The stopper 37*a* is shaped in the form of a continuum cylinder.

The push button 35 is assembled movably in the axial direction of the pipe 26 by passing the shaft 36 from the outside of the case band through the insert tube 26*a* of the pipe 26 and attaching the detent 38 to the shaft 36 inside the case band. After the push button 35 is assembled in this manner, the manipulator head 37 is placed outside the case band 21 of the watch enclosure body 12 and the watertight gasket 39 is compressed and deformed so as to make close contact with the inner surface of the insert tube 26*a* in a slidable manner.

A biasing member 40 is compressed and sandwiched between the push button 35 and the pipe 26, specifically, between the flange 26*c* of the pipe 26 and the manipulator head 37 of the push button 35. The biasing member 40 biases the push button 35 outward with respect to the case band. The biasing member 40 is preferably a coil spring, or may be a belleville spring, leaf spring, or even a rubber elastic body such as urethane rubber.

Figure 2:
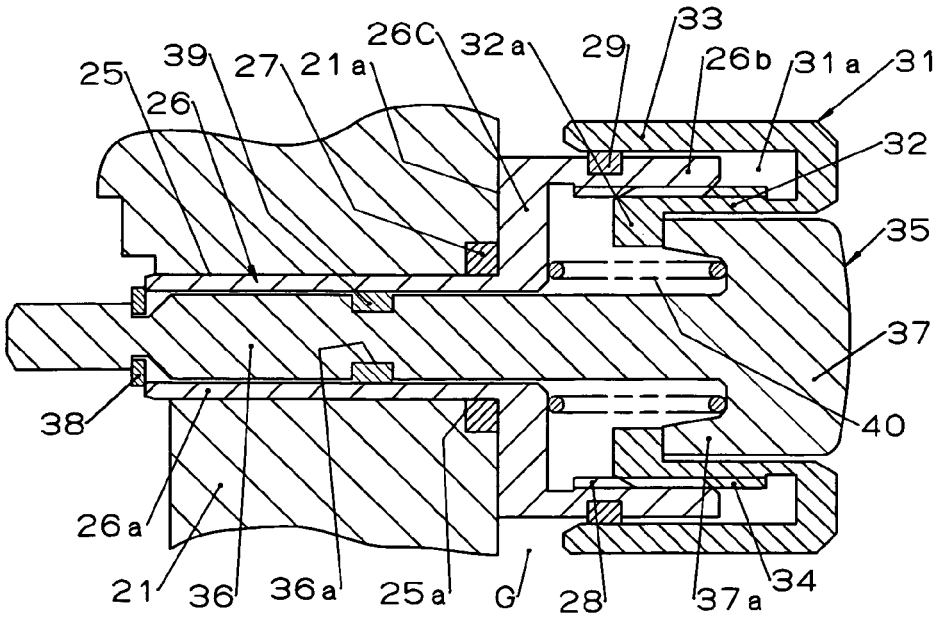
FIG. 2 is a cross-sectional view showing the portion of the watch of FIG. 1 to which a push button is attached with the push button in the locked position.

In the wristwatch 11 thus configured, when the push button 35 is not in use, for example, when the watch is worn on the wrist, the locking member 31 is placed in a locked position where it prevents the push button 35 from being pushed in, as shown in FIG. 2. To change the state shown in FIG. 1 to the state in which the push button 35 is locked, the locking member 31 is rotated, for example, in the clockwise direction.

Specifically, when the finger-grippable surface of the locking member 31 is gripped by the user's fingers and rotated against the rotational resistance caused by the whirl-stop 29, the position where the male thread 34 of the locking member 31 and the female thread 28 of the pipe 26 engage with each other changes, allowing the locking member 31 to move away from the exterior of the case band 21*a*. The movement of the locking member 31 stops when the stopper projection 32*a* of the locking member 31 comes into contact with the stopper 37*a* of the manipulator head 37 of the push button 35, which has been already positioned when the detent 38 biased by the biasing force of the biasing member 40 hits the pipe 26. In the locked state, the locking member 31 is placed such that it covers the entire outer peripheral side surface of the manipulator head 37 and places the end face of the locking member 31 approximately flush with the end face of the manipulator head 37 so that the manipulator head 37 does not jut from or project beyond the locking member 31.

In the above locked state, the locking member 31 blocks the manipulator head 37 as mentioned above. Thus, even if the manipulator head 37 is pushed, the push button 35 cannot be pushed into the case band, thereby preventing accidental operation of the push button 35.

Also in this locked state, the whirl-stop 29 is sandwiched and compressed between the outer wall 33 of the locking member 31 and the retainer tube 26*b* of the pipe 26 such that rotational resistance according to the frictional force generated between the outer wall 33 and the whirl-stop 29 acts on the locking member 31. Thus, vibration or impact applied to the wristwatch 11, when it is worn on the wrist, will not cause accidental rotation and loosening of the locking member 31. In other words, the locking member 31 can be secured such that it will not slide from the locked position in the direction toward the exterior of the case band 21*a*. The locking member 31 is thus configured to maintain its function of locking the push button 35, thereby preventing accidental operation of the push button 35 resulting from the loosened locking member 31 when the wristwatch 11 is worn on the wrist.

In the locked state as shown in FIG. 2, the locking member 31 is away from the exterior of the case band 21*a* and a gap G is created therebetween, which may allow foreign substances such as water or sandy dust to enter. However, as the whirl-stop 29, which provides rotational resistance on the locking member 31, is a ring member for blocking the space between the outer wall 33 and the retainer tube 26*b*, the whirl-stop 29 prevents the foreign substances that enter the gap G from reaching the portion where the male and female threads 34 and 28 engage with each other.

Although the portion where the male and female threads 34 and 28 engage with each other is placed outside the watch enclosure body 12, the engagement portion can be thus water and dust resistant. This prevents the resistance to rotation of the locking member 31 from being abnormally large.

Furthermore, in the locked state, as the circular stopper projection 32*a* of the locking member 31 and the circular stopper 37*a* of the manipulator head 37 abut each other, the abutment portion prevents foreign substances, such as water or sandy dust, that enter the space between the inner wall 32 of the locking member 31 and the manipulator head 37 from entering the pipe 26 beyond the abutment portion. Even if foreign substances passed through the engagement and abutment portions, the watertight gasket 39 sandwiched between the pipe 26 and the push button 35 should prevent the foreign substances from entering the case band. That is, the locked state provides twofold resistance to water and dust.

To operate the push button 35, the locking member 31 is first moved to the unlocked position and then the manipulator head 37 of the push button 35 may be pressed toward the case band 21.

To move the locking member 31 to the unlocked position, the locking member 31 shown in the FIG. 2 is, for example, rotated counterclockwise by the fingers against the rotational resistance generated by the whirl-stop 29. This changes the position where the male and female threads 34 and 28 engage with each other and the locking member 31 moves toward the exterior of the case band 21*a*. The movement of the locking member 31 stops when the outer wall 33 of the locking member 31 abuts the exterior of the case band 21*a* and the inner wall 32 of the locking member 31 abuts the flange 26*c* of the pipe 26. Restricting the movement of the locking member 31 beyond the unlocked position may be achieved by abutment between the outer wall 33 and the exterior of the case band 21*a*, or instead by abutment between the inner wall 32 and the exterior of the case band 21*a*.

Figure 3:
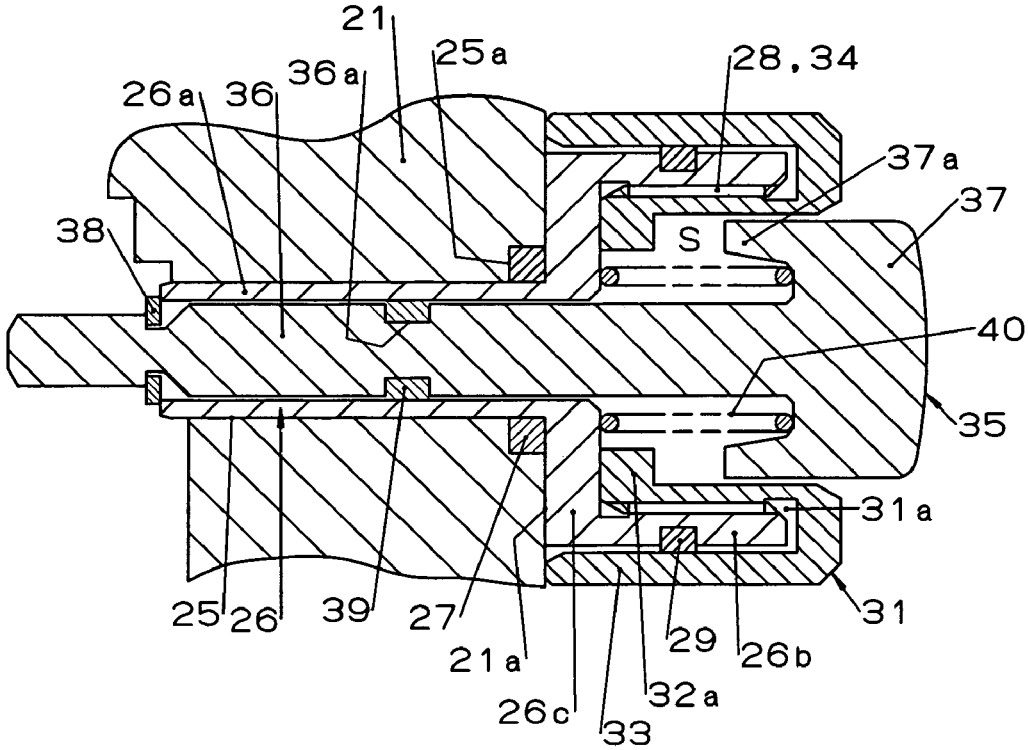
FIG. 3 is a cross-sectional view showing the portion of the watch of FIG. 1 to which a push button is attached with the push button in the unlocked position.

Placing the locking member 31 in the unlocked position separates its stopper projection 32*a* from the stopper 37*a* of the manipulator head 37 and creates a gap S as shown in FIG. 3, allowing the push button 35 to move and leaving the manipulator head 37 jutting from the center of the locking member 31.

Figure 4:
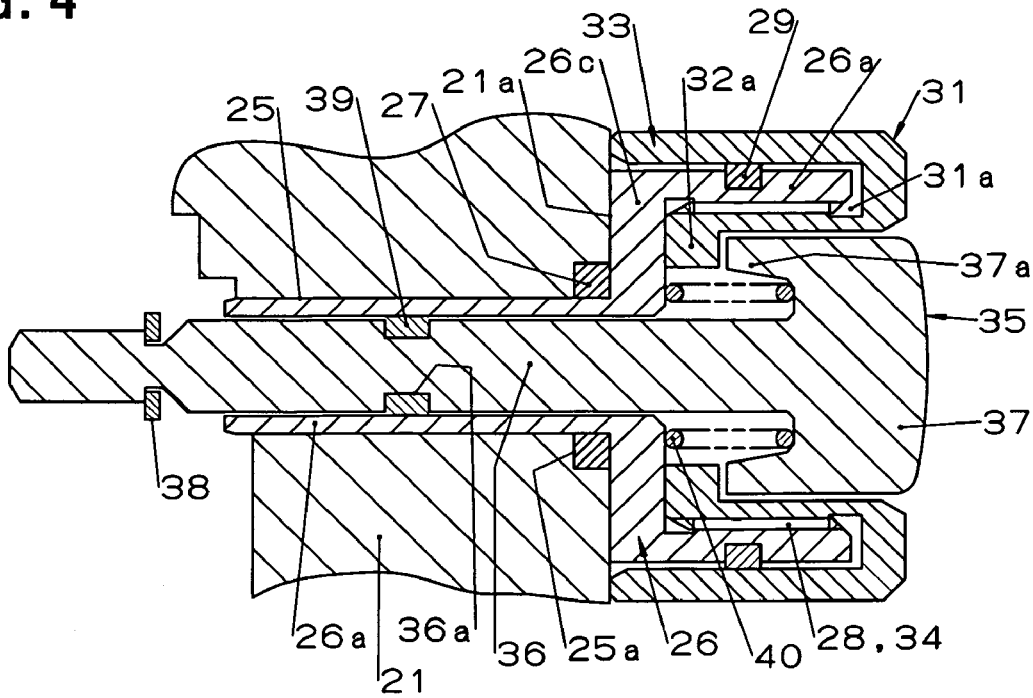
Figure 5:
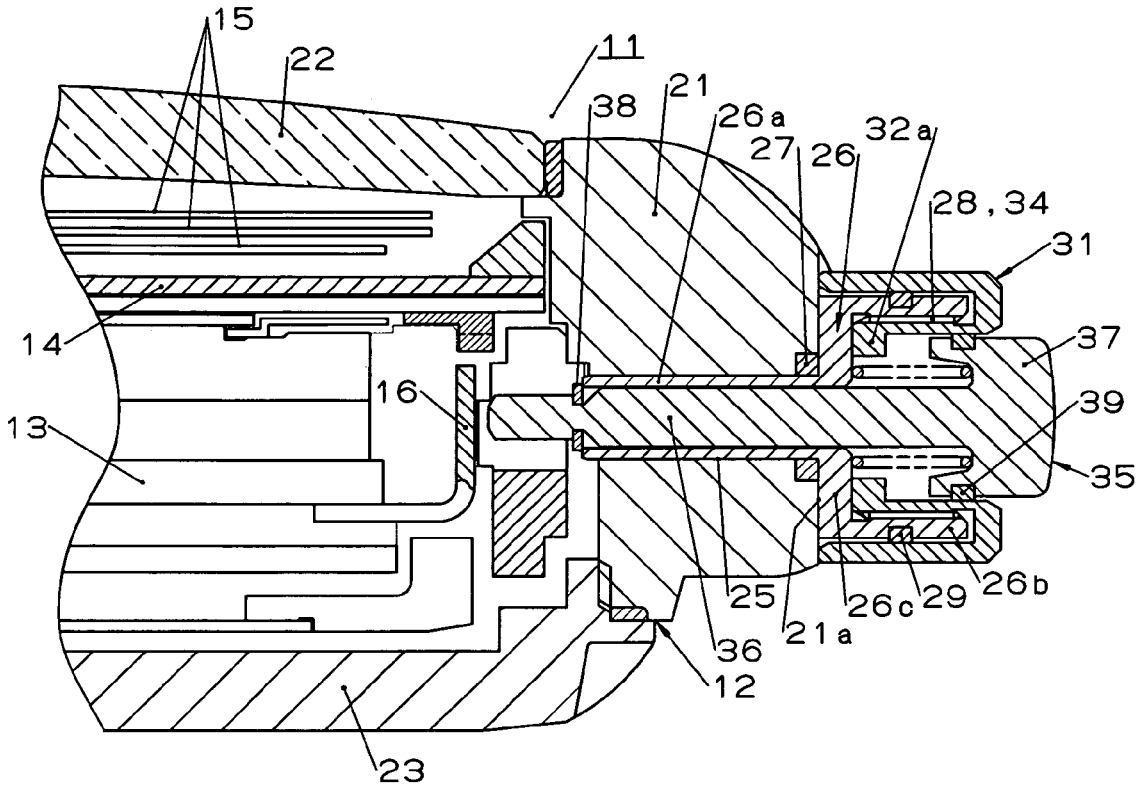
FIG. 5 is a cross-sectional view showing a part of the watch according to a second embodiment of the invention.

Then, as shown in FIG. 4, by pressing the manipulator head 37 while compressing the biasing member 40, the push button 35 is pushed through a distance of the gap S, allowing the push button 35 to push the contact 16 in the case band 21. Subsequently, when the push button 35 is released from the pressing force, the push button 35 is pushed back by the biasing force of the biasing member 40 and placed as shown in FIG. 3. Thereafter, the locking member 31 is rotated clockwise as described above and placed in the locked position as shown in FIG. 2 for carrying the wristwatch 11 on the wrist.

FIGS. 5 to 8 show a second embodiment of the invention. Because this embodiment is similar to the first embodiment except the items to be described below, the configurations that are the same as those of the first embodiment have the same reference numbers and their explanations will be omitted. The second embodiment differs from the first embodiment in the way the watertight gasket 39 is placed.

Specifically, the watertight gasket 39 is not provided between the push button 35 and the pipe 26, but between the push button 35 and the locking member 31 to form a seal. More specifically, the watertight ring gasket 39 is compressed and sandwiched between the manipulator head 37 of the push button 35 and the inner wall 32 of the locking member 31. Although the watertight gasket 39 fits in an annular gasket attachment groove 37*b* provided in the manipulator head 37, which has a greater diameter than the shaft 36, the inner wall 32 may be conversely provided with a gasket attachment groove where the watertight gasket 39 fit in. Alternatively, watertight gaskets 39 may be attached to both the inner wall 32 and the manipulator head 37.

Figure 6:
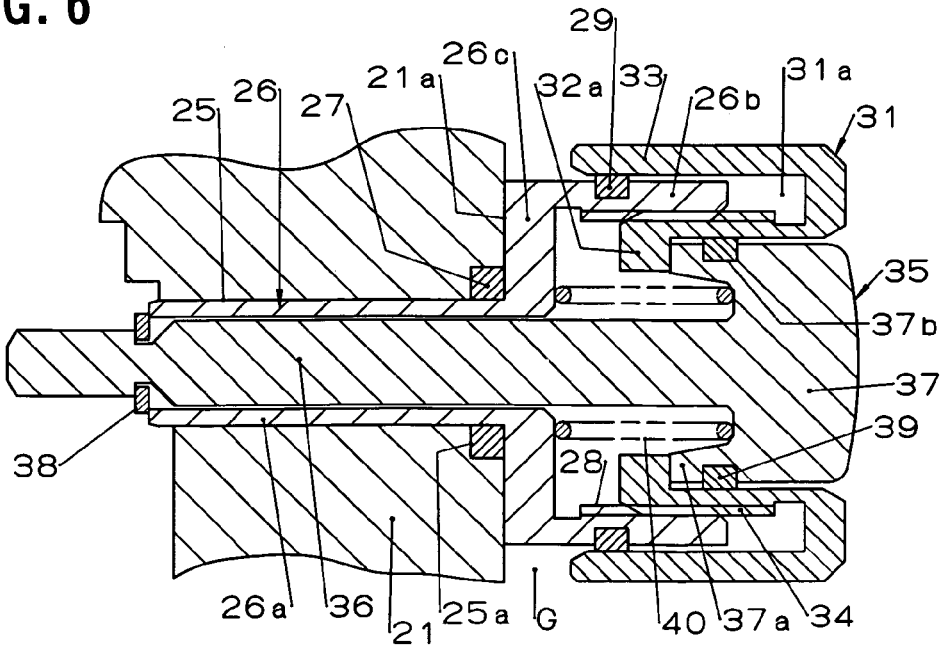
FIG. 6 is a cross-sectional view showing the portion of the watch of FIG. 5 to which a push button is attached with the push button in the locked position.
Figure 7:
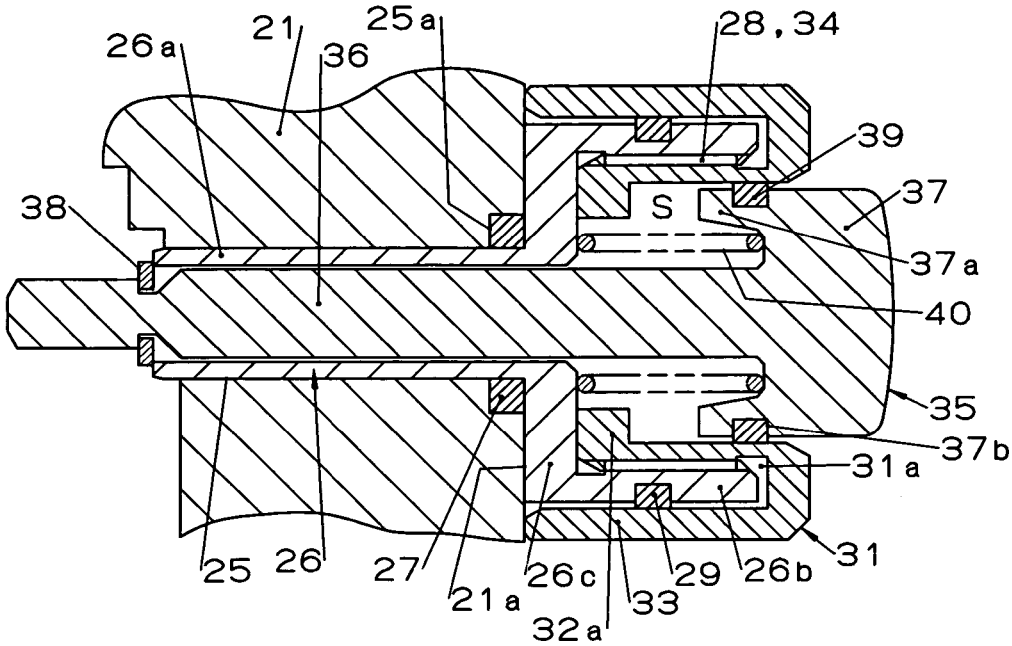
FIG. 7 is a cross-sectional view showing the portion of the watch of FIG. 5 to which a push button is attached with the push button in the unlocked position.
Figure 8:
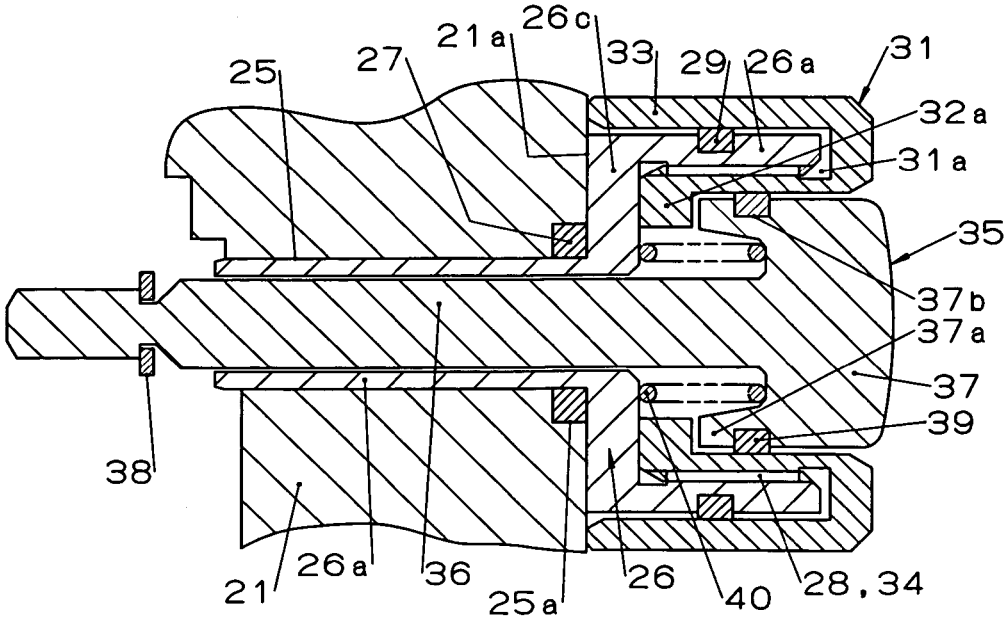

The watertight gasket 39 is made of rubber-based or plastic-based flexible material and shaped into a ring, and has a diameter smaller than that of the ring whirl-stop 29. The watertight gasket 39 and whirl-stop 29 are desirably made of the same material. Therefore, according to the difference in diameter of the watertight gasket 39 and the whirl-stop 29, the frictional force generated between the whirl-stop 29 and the locking member 31 is greater than that between the watertight gasket 39 and the locking member 31. Furthermore, the watertight gasket 39 is disposed on the opposite side of the position of the whirl-stop 29 from the exterior of the case band 21*a* not only when the push button 35 is held such that the locking member 31 placed in the locked position prevents the push button 35 from being pushed in as shown in FIG. 6, but also when the locking member 31 is placed in the unlocked position and the push button 35 is allowed to be pushed in as shown in FIGS. 7 and 8. This embodiment is the same as the first embodiment except the items described above.

Therefore, the second embodiment provides similar advantages to the first embodiment and can solve the problem that the invention addresses. In addition, the second embodiment is superior to the first embodiment in the following respects:

Firstly, the watertight gasket 39 can provide rotational resistance on the locking member 31 according to the frictional force generated between the watertight gasket 39 and the locking member 31. The frictional force of the watertight gasket 39 thus added to the rotational resistance of the locking member 31 more reliably prevents accidental rotation of the locking member 31 placed in the locked position or the like.

Secondly, as the frictional force generated between the watertight ring gasket 39 and the manipulator head 37 of the push button 35 is smaller than the frictional force between the whirl-stop 29 and the locking member 31, the push button 35 will not be too resistant to move but smoothly moves. As the above-mentioned difference in frictional force results from the difference in diameter of the whirl-stop 29 and the watertight gasket 39, an advantage of this embodiment lies in that the whirl-stop 29 and the watertight gasket 39 can be made of the same material.

Thirdly, as the watertight gasket 39 responsible for water and dust tightness of the case band is disposed between the manipulator head 37 and the locking member 31, the shaft 36 of the push button 35, which is accommodated in the insert tube 26*a* of the pipe 26, does not need an annular gasket attachment groove for attaching the watertight gasket 39. Accordingly, the shaft 36 remains intact, as opposed to the case where a gasket attachment groove is formed in the shaft 36 and part of the shaft 36 therefore has a smaller diameter, resulting in decreased strength at that part of the shaft 36. In addition, the manipulator head 37 is enclosed and supported by the locking member 31 with the watertight gasket 39 therebetween, thereby preventing inclined movement of the push button 35 due to the gap between the manipulator head 37 and the inner wall 32 of the locking member 31. Therefore, a further advantage of this embodiment lies in that impact caused, for example, when the wristwatch 11 is dropped will not bend the shaft 36, otherwise resulting in decreased water resistant capability.

Fourthly, the frictional forces generated between the whirl-stop 29 and the locking member 31 as well as between the watertight gasket 39 and the locking member 31 result in reasonable resistance when the locking member 31 is rotated, providing excellent operational feel. In addition, the whirl-stop 29 disposed in the pipe 26 and the watertight gasket 39 disposed in the push button 35 at an axially different position with respect to the whirl-stop position sandwich the thread engagement portion in the radial direction, thereby preventing inclined movement of the locking member 31 due to the gap between the manipulator head 37 and the inner wall 32 of the locking member 31. Therefore, the locking member 31 becomes play-free, allowing smooth rotation thereof.

The invention is not limited to the above embodiments, but is applicable not only to watches but also to other portable apparatus, such as stopwatches, mobile phones, personal digital assistants.

Since the apparatus of the invention includes the locking member 31 having the annular groove 31*a* formed between the inner wall 32 and the outer wall 33 and is configured such that the annular groove 31*a* accommodates the retainer tube 26*b* of the pipe 26, an alternative to the above embodiment may be implemented such that the retainer tube 26*b* and the locking member 31 engage with each other through a male thread formed on the outer surface of the retainer tube 26*b* and a female thread formed on the outer wall 33. In this case, the whirl-stop 29 may be sandwiched between the retainer tube 26*b* and the inner wall 32.

According to the invention, there is provided a portable apparatus and a watch capable of maintaining a function of preventing accidental operation of the push button when the apparatus is carried on the wearer's body.

What is claimed is:

1. A portable apparatus comprising:

an apparatus enclosure body having a through hole;

a pipe having an insert tube and a retainer tube, the pipe being fixed to the apparatus enclosure body with the insert tube inserted in the through hole and the retainer tube fixedly disposed outside the apparatus enclosure body;

a push button having a shaft extending through the pipe, a detent that prevents the shaft from being pulled out of the pipe, and a manipulator head disposed outside the apparatus enclosure body;

a biasing member that is sandwiched between the push-button and the pipe and biases the push button outward with respect to the apparatus enclosure body;

a rotatable locking member having an inner wall with a stopper projection that comes into contact with and moves away from the manipulator head and an outer wall that fits on the outer surface of the retainer tube, the locking member being threadly attached to the retainer tube and being movable in the axial direction of the retainer tube between a locked state in which the stopper projection contacts the manipulator head and the locking member completely covers the peripheral side surface of the manipulator head, and an unlocked state in which the stopper projection is spaced from the manipulator head and the peripheral side surface of the manipulator head projects outwardly beyond the locking member; and a whirl-stop that is sandwiched between the inner or outer wall and the retainer tube and provides rotational resistance to the locking member.

2. A portable apparatus according to claim 1; wherein a watertight ring gasket is sandwiched between the inner wall of the locking member and the manipulator head.

3. A portable apparatus according to claim 2; wherein the whirl-stop comprises a ring member, and the frictional force between the watertight gasket and the manipulator head is smaller than the frictional force between the whirl-stop and the locking member.

4. A portable apparatus according to claim 1; wherein the portable apparatus is a watch.

5. A portable apparatus according to claim 1; wherein the whirl-stop is sandwiched between the outer wall and the retainer tube.

6. A portable apparatus according to claim 1; wherein the whirl-stop is ring-shaped and composed of rubber-based or plastic-based material.

7. A portable apparatus comprising: an apparatus enclosure body having a through hole; a tubular member having a tubular insert portion inserted in the through hole and fixed to the apparatus enclosure body and a tubular retainer portion integral with the insert portion and disposed entirely outside the apparatus enclosure body; a depressible push button having a shaft slidably extending through the tubular member and a manipulator head connected to the shaft and disposed outside the apparatus enclosure body; a biasing member that biases the push button outward with respect to the apparatus enclosure body; a rotatable locking member having opposed spaced-apart inner and outer walls, one of the walls being threadedly engaged with the tubular member retainer portion and the other wall being slidably disposed on the tubular member retainer portion, the inner wall having a stopper projection and the outer wall having a finger-grippable surface that can be gripped by a user of the portable apparatus to rotate the locking member in opposite directions to displace the locking member, when rotated in one direction, away from the apparatus enclosure body to move the stopper projection into contact with the manipulator head to prevent depression of the push button and to displace the locking member, when rotated in the other direction, toward the apparatus enclosure body to move the stopper projection away from the manipulator head to permit depression of the push button; and a ring member interposed between the inner or outer wall of the locking member and the tubular member retainer portion to impart rotational resistance to the locking member.

8. A portable apparatus according to claim 7; wherein the ring member is comprised of deformable material and is interposed in a compressively deformed state between the inner or outer wall and the tubular member.

9. A portable apparatus according to claim 7; wherein the ring member is composed of rubber-based or plastic-based material.

10. A portable apparatus according to claim 7; wherein the manipulator head has an outer end face and a peripheral side surface that extends from the end face inward toward the apparatus enclosure body, and the locking member surrounds and completely covers the peripheral side surface of the manipulator head when the stopper projection is moved into contact with the manipulator head.

11. A portable apparatus according to claim 10; wherein the portable apparatus is a watch.

12. A portable apparatus according to claim 10; further including a watertight gasket interposed between the inner wall of the locking member and the manipulator head.

13. A portable apparatus according to claim 12; wherein the watertight gasket is comprised of deformable material and is interposed in a compressively deformed state between the inner wall of the locking member and the manipulator head and imparts rotational resistance to the locking member.

14. A portable apparatus according to claim 13; wherein the ring member is comprised of deformable material and is interposed in a compressively deformed state between the inner or outer wall and the tubular member.

15. A portable apparatus according to claim 14; wherein the watertight gasket is located farther from the apparatus enclosure body than the ring member.

16. A portable apparatus according to claim 7; wherein the one wall threadedly engaged with the tubular member retainer portion is the inner wall and the other wall slidably disposed on the tubular member retainer portion is the outer wall.

17. A portable apparatus according to claim 16; wherein the opposed spacedapart inner and outer walls are connected together at outer ends thereof and define therebetween an annular groove that is open toward the apparatus enclosure body, the tubular member retainer portion extending outward into the annular groove.

18. A portable apparatus according to claim 7; wherein the opposed spacedapart inner and outer walls are connected together at outer ends thereof and define therebetween an annular groove that is open toward the apparatus enclosure body, the tubular member retainer portion extending outward into the annular groove.

19. A portable apparatus according to claim 18; wherein the manipulator head has an outer end face and a peripheral side surface that extends from the end face inward toward the apparatus enclosure body, and the locking member surrounds and completely covers the peripheral side surface of the manipulator head when the stopper projection is moved into contact with the manipulator head.

20. A portable apparatus according to claim 7; wherein the tubular member includes a flange portion interconnecting the insert portion and the retainer portion.

* * * * *